US010278239B2

(12) United States Patent
Pastore et al.

(10) Patent No.: US 10,278,239 B2
(45) Date of Patent: Apr. 30, 2019

(54) COOLING ASSEMBLY FOR AN INDUCTION HOB

(71) Applicant: WHIRLPOOL CORPORATION, Benton Harbor, MI (US)

(72) Inventors: Cristiano Pastore, Comerio (IT); Luca Zilio, Biandronno (IT)

(73) Assignee: Whirlpool Corporation, Benton Harbor, MI (US)

( * ) Notice: Subject to any disclaimer, the term of this patent is extended or adjusted under 35 U.S.C. 154(b) by 328 days.

(21) Appl. No.: 15/060,779

(22) Filed: Mar. 4, 2016

(65) Prior Publication Data

US 2016/0262217 A1 Sep. 8, 2016

(30) Foreign Application Priority Data

Mar. 4, 2015 (EP) ..... 15157676

(51) Int. Cl.
*H05B 6/12* (2006.01)
*H05B 6/42* (2006.01)

(52) U.S. Cl.
CPC ..... *H05B 6/1263* (2013.01); *H05B 6/42* (2013.01); *H05B 2206/022* (2013.01)

(58) Field of Classification Search
CPC ... H05B 6/1263; H05B 6/42; H05B 2206/022
USPC ..... 165/80.3, 121; 219/622, 623, 627, 632, 219/677
See application file for complete search history.

(56) References Cited

U.S. PATENT DOCUMENTS

2003/0131970 A1* 7/2003 Carter ..... B21C 23/10 165/80.3
2007/0278215 A1* 12/2007 Schilling ..... H05B 6/1263 219/622
2009/0020262 A1* 1/2009 Zhang ..... H01L 23/3672 165/80.3
2009/0145581 A1* 6/2009 Hoffman ..... F28F 1/40 165/80.3

FOREIGN PATENT DOCUMENTS

FR 2727600 A1 * 5/1996 ..... H01L 23/467
JP 2005302406 A 10/2005
JP 2007234623 A * 9/2007 ..... H05B 6/1263
JP 2008108752 A 5/2008
WO 2011154373 A1 12/2011

OTHER PUBLICATIONS

European Search Report dated Sep. 10, 2015 for Application No. 15157676.6 filed Mar. 4, 2015.

* cited by examiner

*Primary Examiner* — Thien S Tran
(74) *Attorney, Agent, or Firm* — Price Heneveld LLP

(57) ABSTRACT

A cooling system for an induction-based cooking hob includes a first heat-generating device having a first heat sink coupled therewith and having a plurality of free ends extending away from the first heat generating device along a plane and a first induction coil positioned adjacent the heat sink. The cooling system further includes a blower module defining a cooling air path extending in a first direction substantially perpendicular to the plane. The first heat sink and the first induction coil are positioned along respective portions of the cooling air path with the first heat sink closest to the blower module.

19 Claims, 4 Drawing Sheets

COOLING ASSEMBLY FOR AN INDUCTION HOB

CROSS-REFERENCE TO RELATED APPLICATION

This application claims priority to European Patent Application No. 15157676.6 filed on Mar. 4, 2015, entitled "COOLING ASSEMBLY FOR AN INDUCTION HOB," the disclosure of which is hereby incorporated herein by reference in its entirety.

BACKGROUND

The present device generally relates to a cooling system for an induction hob provided with improved efficiency and versatility. In particular, a cooling system is provided for various high frequency inverters of some cooking hobs and the induction coils thereof, which are contributors to heat generated within the appliance.

Solutions for cooling induction cooking systems have been based on heat sink blocks, which may be typically made of extruded aluminum and to which electronic heat generating devices are attached. By the extruded nature of such heat sinks, the fins define cooling channels along a direction substantially parallel to the extrusion direction. These fins are usually ventilated by means of centrifugal blowers.

Such solutions have the disadvantage of becoming inefficient when the extrusion length of the heat sink increases. In fact, as the air is flowing along the heat sink path it gets progressively hotter as it absorbs heat from the heat sink surface. As a result, at the terminal end portion of the extruded heat sink the air temperature is significantly hotter than the air at the outlet of the blower. This results in a much lower capability to extract heat per unit area from the heat sink surface.

Other solutions for cooling induction systems have been based on the use of an axial fan projecting airflow onto a metal surface orthogonal with respect to the axial direction. This arrangement, which is typically used in single coil systems, entailing just two or three silicon devices to be cooled, has the disadvantage to be physically large both in the flow direction and in the orthogonal-to-flow direction, resulting in geometries hardly adaptable to low-profile built-in cook-tops.

Further solutions have consisted of an air blower having a semi-volute, positioned around a propeller to make air to directly flow on power components that form obstacles to passage of air flow evacuated by the blower. This solution has the combined disadvantage of creating high air pressure drop of the airflow (due to the impinged flow caused by the flat surface directly facing the fan outlet) and a relatively small heat-exchange surface compared to a "long extruded" heat sink. In fact the small heat-exchange surface substantially corresponds to the fan mouth (outlet) area. Accordingly, further advances may be desired.

SUMMARY

In at least one aspect, a cooling system for an induction-based cooking hob includes a first heat-generating device having a first heat sink coupled therewith and having a plurality of free ends extending away from the first heat generating device along a plane and a first induction coil positioned adjacent the heat sink. The cooling system further includes a blower module defining a cooling air path extending in a first direction substantially perpendicular to the plane. The first heat sink and the first induction coil are positioned along respective portions of the cooling air path with the first heat sink closest to the blower module.

In at least another aspect, an induction cooking hob includes a first heat-generating device, a first induction coil positioned adjacent the first heat-generating device, and a cooling system. The cooling system has a first heat sink coupled with the first heat-generating device and having a plurality of free ends extending away from the first heat generating device along a plane. A blower module of the cooling system defines a cooling air path extending in a first direction substantially perpendicular to the plane. The first heat sink and the first induction coil are positioned along respective portions of the cooling air path with the first heat sink closest to the blower module.

In at least another aspect, a method for manufacturing an induction cooking hob includes determining a first operating temperature range of a first heat-generating device having a first heat sink coupled therewith and having a plurality of free ends extending away from the first heat generating device along a plane and determining a second operating temperature range of a first induction coil positioned adjacent the heat sink. The method further includes configuring at least one air inlet and at least one corresponding air outlet in a casing with which the first heat generating device and the first induction coil are mounted. The at least one air inlet and at least one corresponding air outlet are associated with a cooling air path extending in a first direction substantially perpendicular to the plane and impinging successively on the first heat sink and the first induction coil and are configured to provide adequate air to the cooling air path to maintain respective temperatures of the first heat-generating device and the first induction coil within a lesser of the determined first and second operating ranges.

These and other features, advantages, and objects of the present disclosure will be further understood and appreciated by those skilled in the art upon studying the following specification, claims, and appended drawings.

DETAILED DESCRIPTION OF EMBODIMENTS

Figure 1A:
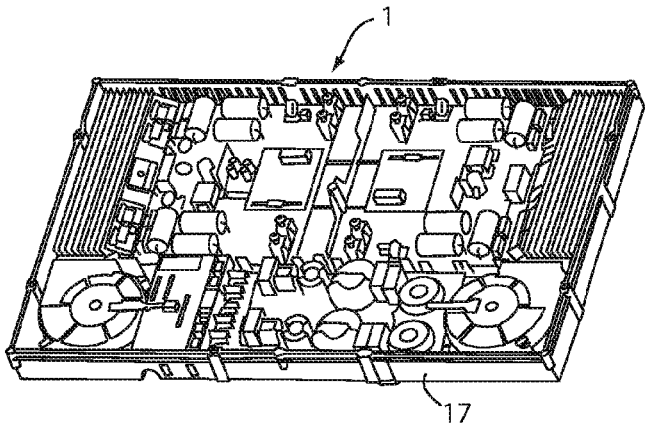
FIG. 1A Related Art
FIG. 1A shows a perspective view of an induction hob provided with a related art cooling system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to the above cited Figures it is hereafter described a non-limiting example of an induction hob 1 provided with a cooling system according to the present invention. The induction hob comprises a ceramic glass 100 on which cooking utensils to be heated such as pot, pans casseroles or the like, can be placed.

Below said ceramic glass a plurality of induction pancake coils (at least two) 8, 8*a* and 8*b* (named also as inductors) are disposed, preferably in direct contact with said glass. Preferably such coils 8, 8*a*, 8*b* are provided with a shape suitable to match, alone or in combination with other coils, the shape of a superposed cooking article. In one embodiment the induction hob is provided with two induction coils 8*a* and 8*b*. In another embodiment the induction hob is provided with four induction coils disposed as four traditional gas burners. In another embodiment the induction hob 1 is configured with a plurality of induction coils that can be operated in order to create separate and/or combined heating zones. In one aspect, ferritic material can be placed below the coils and assembled with them in order to properly shape the electromagnetic field.

Inductors 8, 8*a* and 8*b* can be supported by one or more supports 7, preferably comprising parts made of aluminum. According to one embodiment, the disposition of one or more of these supports 7 can define at least one opening 11 through which air for cooling the inductors 8, 8*a* and 8*b* can flow.

According to another embodiment, the opening 11 can be defined within the support 7. Such an opening 11 can be disposed among the induction coils 8, 8*a* and 8*b* and can be located centrally within the hob 1.

An electronic (PCB) board 14 may be disposed in a layer below the inductors 8, 8*a*, and 8*b* and may include a driving circuit for driving the induction coils 8, 8*a*, and 8*b*. Such driving circuit includes heat generating devices 2, which may be electronic components that generate heat during operations, such as solid state switches, particularly IGBTs, TRIACs and voltage rectifiers. At least one of the heat generating devices 2 is connected to a heat sink 3, 3*a* and 3*b* that is provided with free-ends 4 (terminals, pins, or fins, for example) to dissipate heat. Connection can be made by various thermal interface materials. The heat sink can be supported by the electronic board 14. In one embodiment the heat sink 3 is provided with fins or pins 4 and is made of extruded aluminum or aluminum alloy.

Figure 2:
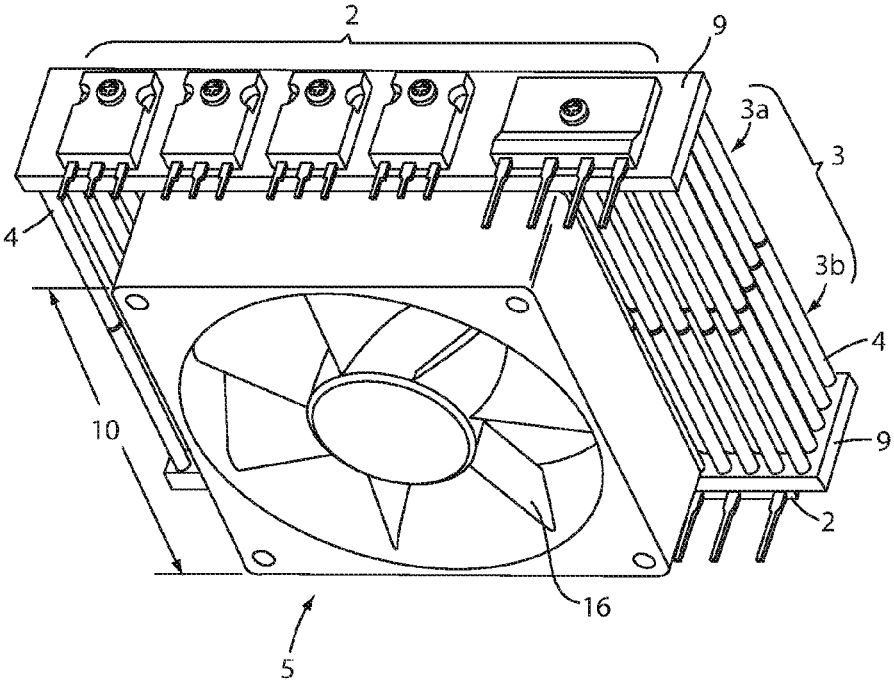
FIG. 2 shows a perspective view of a first assembly arrangement of a heat sink and a cooling fan.
Figure 3:
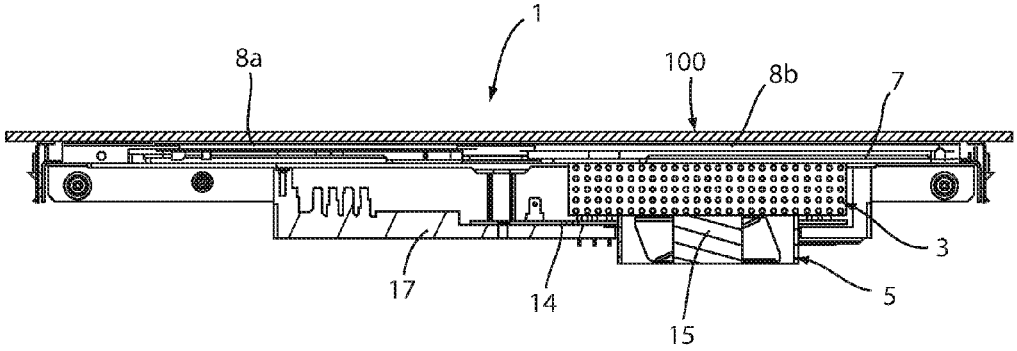
FIG. 3 shows a cross section of an induction hob provided with a cooling system, in which the assembly arrangement of FIG. 2 is included.

As shown in FIG. 2, the heat sink 3 may have a multitude of free-ends 4 (which may also be referred to as terminals, "fingers", or pins), which may be cylinders, protruding out of a solid base block that may be made of metal or other suitable materials.

Figure 1B:
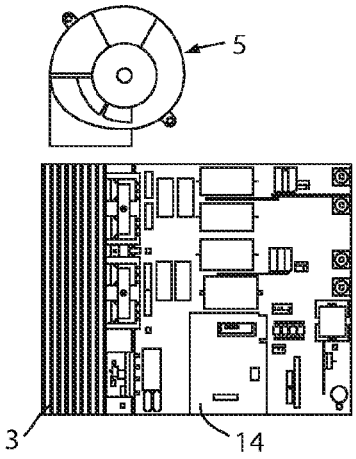
FIG. 1B Related Art
FIG. 1B shows an enlarged detail of the related art cooling system of FIG. 1A.

The system depicted herein in FIG. 2, and described in further detail and variations below, contrasts with the example of a related cooling system depicted in FIGS. 1A and 1B. In such a system the IGBTs (Insulated Gate Bipolar Transistors) and the bridge rectifier are the electronic devices requiring the largest amount of cooling power. Both the electronic devices are typically assembled into packages having one flat surface designed to mate one corresponding flat surface of the extruded heat sink. Typically, in a four burner appliance, the number of electronic devices generating heat that are required to be cooled is in the range from 6 to 10 depending on inverter topology, and they are typically arranged in one of two rows along the extrusion long side of the heat sink, as illustrated in FIG. 1A.

As understandable by the Newton law of convection heat exchange:

$$\frac{dQ}{dt} = h \cdot A(T(t) - T_{env}) = h \cdot A\Delta T(t)$$

wherein:

Q is the thermal energy [joules];

H is the heat transfer coefficient (assumed independent of T here) [W/m$\hat{0}$2° K];

A is the surface area of the heat being transferred [m$\hat{0}$2];

T is the temperature at the heat sink surface [° K];

$T_{env}$ is the temperature of the environment; i.e. the temperature suitably far from the surface [° K]; and $\Delta T(t)=T(t)-T_{env}$ is the (time-dependent) thermal gradient between environment and object.

Beginning with Newton's law, it is possible to demonstrate that for a linear extruded heat sink the heat exchange capacity per unit of area (i.e. per unit length, given the extrusion constant cross section) corresponds approximately with the square root of the length itself, resulting in poor cooling efficiencies as the extrusion length increases. In other words, it can be said that doubling the length of the extrusion doubles its weight and material cost, but increases its cooling capability by just a factor of 1.41 (i.e., the square root of two).

The efficiency of such "long extruded systems" could be further impaired by the air-flow leakage along the path that could arise if the heat sink is not inserted inside a sort of air-duct. However, a completely sealed duct is typically not designed nor implemented, as it is also desirable to spill part of the airflow generated by the blower (not using the main airflow stream) to further cool other parts of the induction system, including the pancake induction coils and/or other portions of the electronic system not directly connected to the heat sink. As a result of that partial air "spillage", the efficiency of the long extrusion system is further impaired, resulting in a lower heat extraction capacity per unit of area.

Further reducing the efficiency of "long extruded system" is the presence of laminar flow that establishes at the boundary of the heat sink surface. As known, a laminar flow results in a much lower convective heat factor coefficient h vs. a turbulent flow so that a further degradation of the performances of such a system is expected. In this manner the present system, by contrast, conjugates a low temperature gradient along the air path, resulting in a more efficient use of the exchange surface and reduces a pressure drop, resulting in higher air velocities for a given blower, thereby potentially improving efficiency of the induction hob.

Figure 6:
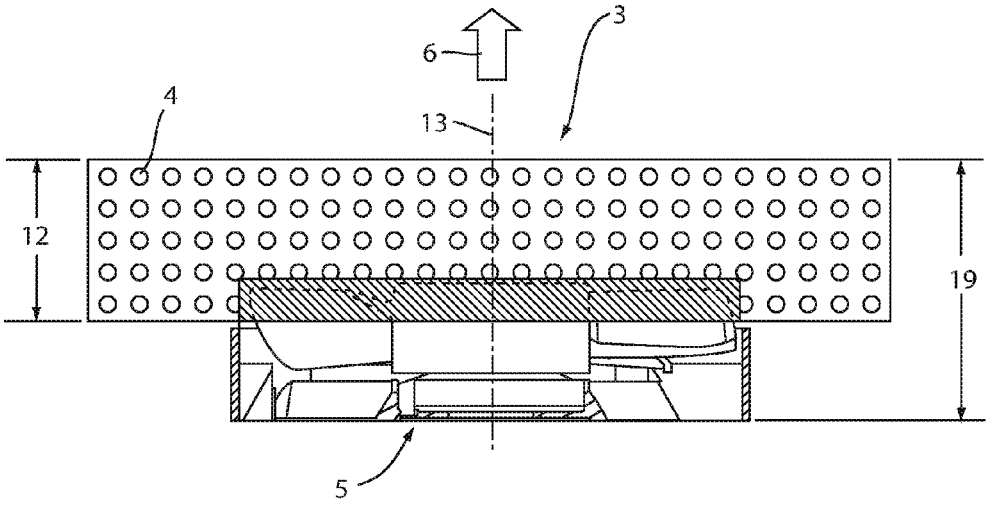
FIG. 6 shows an further assembly arrangement of a heat sink and a cooling fan.

In a variation of the hob 1 shown in FIG. 6, the fan blower module 5 is shown as partially protruding into a volume of said free-ends 4 of said heat sink 3. This arrangement may further reduce the overall height 19 of the cooling system, particularly of the assembly arrangement of a heat sink and a cooling fan. Further, as shown in FIG. 6, pins 4 in the protrusion volume are removed to avoid interference with the impeller (i.e. the blower module). In addition to the potential reduction in height 19, this arrangement may have the advantage of utilizing both the axial action and the centrifugal action of the impeller, potentially resulting in an increased cooling efficiency.

Figure 7:
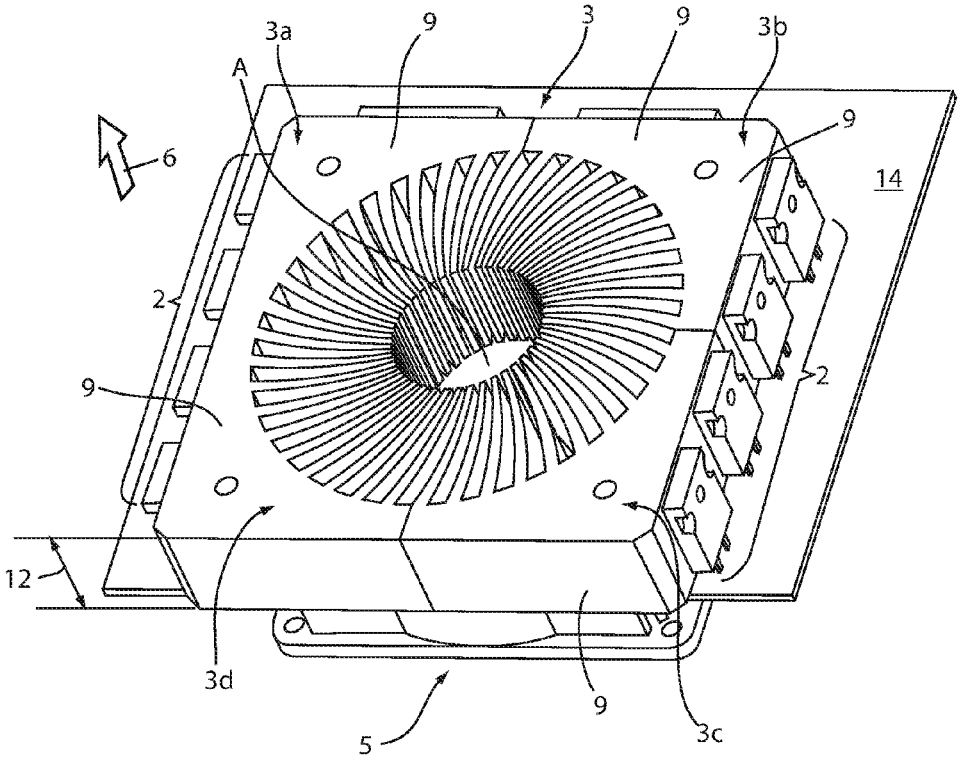
FIG. 7 is a perspective view of a still further assembly arrangement of a heat sink and a cooling fan.

In a further variation illustrated in FIG. 7, the heat sink free-ends 4 are fins provided in a radial or helical arrangement.

A properly dimensioned blower module 5 (also referred to herein as an impeller or as a cooling fan) is provided for generating an airflow path that impinges the heat sink 3, 3*a* and 3*b* to remove the heat therefrom, which may help to maintain the temperature of the heat generating devices within acceptable operating limits.

According to one configuration, the heat sink 3 may define a plane that is substantially perpendicular with respect to the airflow path direction 6 generated by a blower 5 in a short path arrangement. This arrangement may provide an increase in the heat exchange surface. For extruded heat sinks the extrusion direction may be parallel to the airflow path direction 6. A short path arrangement may, additionally or alternatively, include either a direct assembly of the blower module 5 and of the heat sink 3, 3*a,* and 3*b,* or any close arrangement of the two parts for cooling purposes. This may include the use of additional intermediate components (for example, air baffles, gaskets and the like). In this arrangement, the blower module 5 can be assembled with the heat sink 3, 3*a* and 3*b,* and may be connected above or below said heat sink 3 with removable connecting means (such as screws, bolts, or the like).

Figure 5:
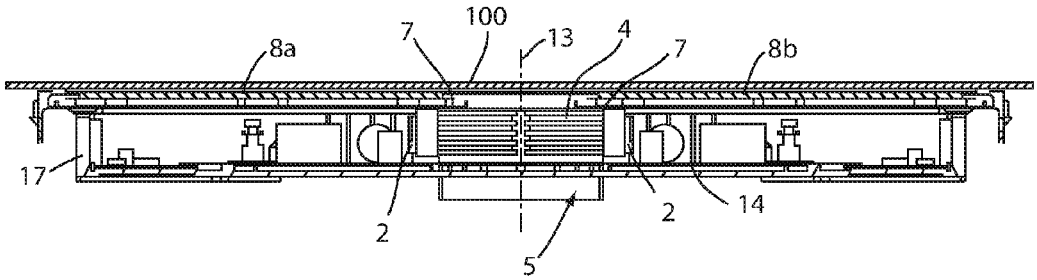
FIG. 5 shows a variation of the cooling system of FIG. 3.

According to another embodiment, shown in FIG. 5, the blower module 5 may be fixed externally to the induction hob casing structure 17. In such an arrangement, direction 6 of the main airflow path impinging the heat sink 3, 3*a* and 3*b,* and/or of the blower rotational axis 13 may be slightly inclined compared to a perpendicular direction of said free-ends 4. Such airflow paths may also be compatible with other examples and embodiments discussed herein and may be achieved including by the use of additional airflow diverters.

The height 12 of the heat sink 3, in the major direction 6 of the impinging airflow path, i.e. the cooling path, is lower than in any other dimension. This may help to maintain the height of the cooling system to a relatively low overall height while maintain appropriate cooling efficiency. This arrangement may be particularly useful for built-in induction hobs.

Air may be sucked by the blower 5 from the outside of the hob 1 through an aperture 15 (an inlet) in the casing structure 17 of the induction hob 1. Such an aperture 15 may be placed in the lower part of its enclosure, preferably in the bottom wall of the casing structure 17.

The blower 5 may be an axial blower, which may be described as a blower in which the blades 16 rotate about an axis 13 that is substantially normal with respect to the plane of the electronic board 14 (and potentially also with respect to the plane of the installed hob) onto which the electronic devices 2 generating heat are mounted.

In one aspect, the blower module 5 may be an axial blower having a diameter 10 that substantially matches the dimensions of the free-ends region of the heat sink. Further, blower 5 may be connected in an assembly with two heat sinks 3*a,* 3*b,* each of which may be of the type having multiple free-ends 4 shaped as pins and connected to a common end element (and protruding from it like in a brush), such as a solid block element 9, to which heat generating devices 2 are connected. The two heat sinks 3*a* and 3*b* and can be two symmetric modules facing each other. The symmetric modules can be spaced apart. The free-ends 4 protruding out of the solid base block element 9 may be shaped as cylindrical pins. The free-ends ends 4 of the two heat sinks 3*a* and 3*b* may, further, be disposed in an ordered manner, including the ones of the free ends 4 that face facing corresponding others of the free ends. The construction of two heat sinks 3*a* and 3*b* may be identical, and the symmetric shape may be obtained using extruded aluminum or similar materials.

As shown in FIG. 7, the blower module 5 may be connected with four identical heat sinks 3*a,* 3*b,* 3*c,* or 3*d* each of them obtained by extruded aluminum or similar materials. The four heat sinks 3*a,* 3*b,* 3*c,* and 3*d* present radial or helical arrangement of the free-end parts 4 and, when assembled, one close to the other, facing each other, in order to define a central cylindrical air channel A.

According to the present invention the main airflow path impinging the heat sink 3 is further directed to cool other components of the induction hob 1 that require cooling. The main airstream coming out from the heat sink and free-ends 4 may still have enough cooling capacity to cool down, for instance, the pancake coil windings 8, 8*a* and 8*b,* located downstream the heat sink. In this manner, the airflow at the exit of the heat sink 3 may pass through the opening 11 within the hob before being further directed to cool down other components.

After passing by the heat sink free-ends 4, the cooling air flow may be further directed to impinge the aluminum tray 7 supporting the induction coils 8, 8*a* and 8*b* that overlie the heat sink. The advantage of such arrangement is that the air coming from the heat sink (which has a temperature that is between approximately 80 and 100° C.) may still be significantly cooler than the temperature of the coils, which may reach temperatures up to 180° C. Thus, the cooling air flow can be used to cool other components before being exhausted to the environment. This will allow the use of a reduced airflow, and the potential of an overall energy reduction.

Figure 4:
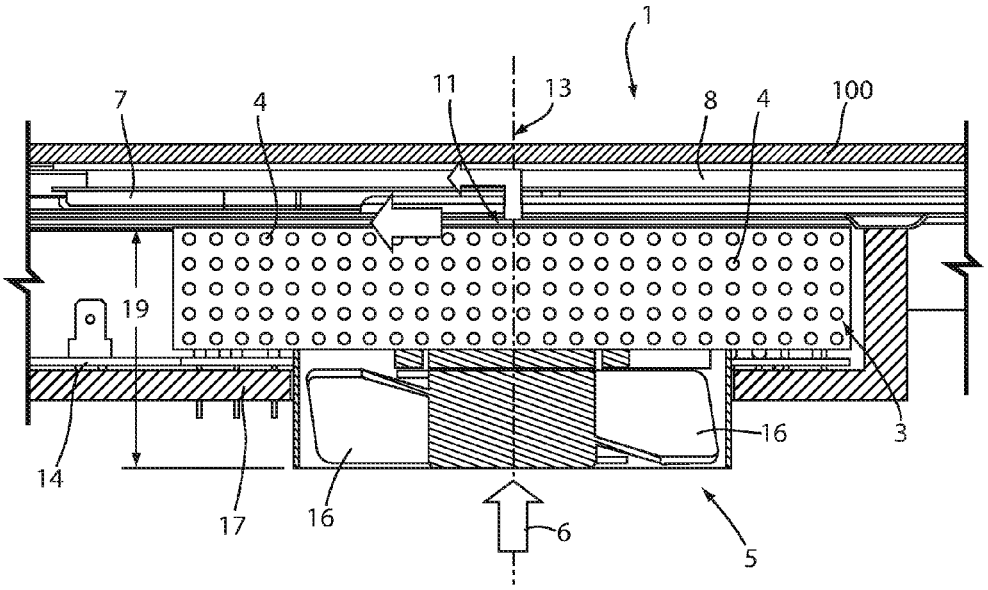
FIG. 4 shows a detail of the cooling system of FIG. 3 in which airflow paths are represented.

As shown in FIG. 4, the airflow at the exit of the heat sink 3 can be channeled through an air channel defined by one or more supports 7 and the ceramic glass 100 and can be further directed to cool portions of the inductors 8, 8*a* and 8*b*. The cooling path can then be directed to an outlet of the induction hob casing structure 17.

The above-described structure may lead to increased versatility of the configuration of the cooling system described herein. In fact, inlets and outlets of the airflow path may benefit from not be located in a fixed predefined position of the hob, but can be opened in the casing structure 17 of the induction hob according to the geometric disposition of the inductors 8, 8*a* and 8*b*. This disposition itself depends on the configuration and/or model of the induction hob 1 being manufactured, and is aimed at maintaining the temperature of the heat generating devices within predetermined acceptable operating conditions.

Figure 8:
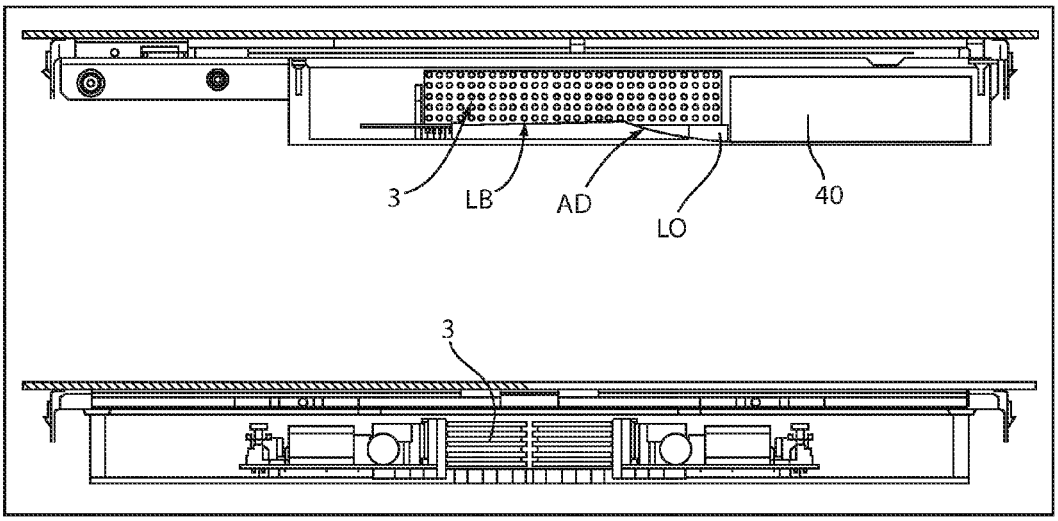
FIG. 8 is a sectional view of an alternative a cooling system.
Figure 9:
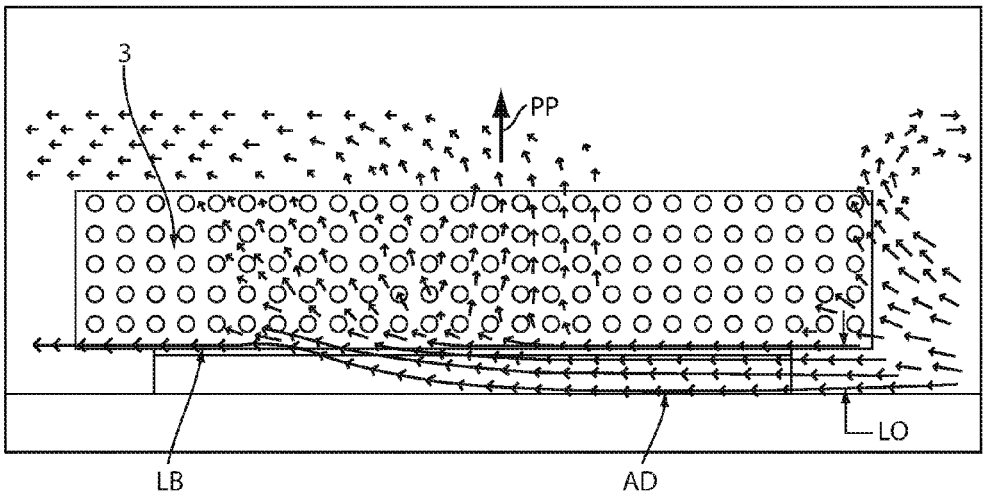
FIG. 9 shows plots of the cooling performance related to the system of FIG. 8.

In certain instances where it may not be optimal or feasible to house an axial fan into the induction hob, a similar solution according to variations of the arrangement described above can be used with a centrifugal fan 40, such as a radial blower. In such a variation, shown in FIG. 8, the radial fan can be placed on a lateral side of the heat sink with a predetermined lower offset LO respect to the heat sink lower base LB. Due to the offset disposition of the fan, a portion of the air flow outgoing from the fan outlet may directly impinge the pins (or "fingers") 3 of the heat sink, and the remaining portion of the air flow may be driven through the bottom part of the heat sink. This remaining airflow portion is then moved along various directions by an air deflector AD to provide to the air flow with a vertical component PP of velocity. In such a manner, the same technical effect obtained through the axial fan, as described elsewhere, may be achieved. The air deflector AD, which may be coupled with the lower part of the hob structure, in combination with the dimension of the predetermined lower offset LO, can be designed for deflecting the remaining portion of the airflow in such a way to increase the vertical component of the airflow rate, thereby enhancing the cooling capacity of the arrangement. In FIGS. 9*a* and 9*b*, reported plots of cooling performance simulations related to this variation are shown.

It is here reminded that any combination of the single features described for each single embodiment can be applied, where possible, to any other embodiment.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooling system for an induction-based cooking hob, comprising:

a first heat-generating device defining a first plane and having a first heat sink coupled therewith, the first heat sink having a plurality of free ends extending away from the first heat generating device away from the first plane;

a first induction coil positioned adjacent the heat sink; and a blower module defining a cooling air path extending in a first direction substantially perpendicular to the plurality of free ends, wherein the first heat sink and the first induction coil are aligned with the blower module in the first direction so as to be positioned along the cooling air path with the first heat sink closest to the blower module.

2. The cooling system of claim 1, wherein the cooling air path of the blower module and the first direction extend along an axial direction of the blower module, the cooling path impinging on the free ends of the heat sink.

3. The cooling system of claim 1, wherein the free ends of the heat sink are generally cylindrically pin shaped and protrude normally from a solid block element coupled with and extending along the first heat-generating device.

4. The cooling system of claim 1, wherein the free ends of the heat sink are generally fin-shaped and extend in one of a radial or a helical arrangement from a solid base block coupled with the first heat-generating device.

5. The cooling system of claim 1, further including a second heat-generating device defining a second plane and having a second heat sink coupled therewith, the second heat sink having a plurality of free ends extending away from the second heat generating device away from the second plane and toward the free ends of the first heat sink; wherein the second heat sink is symmetric with and faces the first heat sink.

6. The cooling system of claim 1, wherein the blower module at least partially protrudes into a volume of the free-ends of the first heat sink.

7. The cooling system of claim 1, further including a first support coupled with the first induction coil and defining at least one opening therethrough, the cooling air path passing through the at least one opening.

8. The cooling system of claim 7, wherein the at least one opening is located in a central position of the cooking hob.

9. The cooling system of claim 1, further including an aluminum tray supporting the induction coil, wherein:

the cooling air path impinges the aluminum tray in the first direction.

10. The cooling system of claim 1, wherein a height of the heat sink along the first direction is less than a depth and a width of the heat sink that are respectively defined normal to the plane.

11. The cooling system of claim 1, wherein the blower module is an axial blower defining a diameter that substantially matches a dimension of the first heat sink defined normal with the plane.

12. The cooling system of claim 1, wherein the blower module includes a plurality of blades that rotate about an axis substantially parallel to the plane.

13. An induction cooking hob, comprising:

a first heat-generating device defining a first plane;

a first induction coil positioned adjacent the first heat-generating device; and a cooling system, including:

a first heat sink coupled with the first heat-generating device and having a plurality of free ends extending away from the first plane of the first heat generating device along a plane; and a blower module defining a cooling air path extending in a first direction substantially perpendicular to the plurality of free ends of the first heat sink, wherein the first heat sink and the first induction coil are aligned with the blower module in the first direction so as to be positioned along respective portions of the cooling air path with the first heat sink closest to the blower module.

14. The induction cooking hob of claim 13, further including a second heat-generating device defining a second plane and spaced apart from the first heat-generating device, wherein:

the cooling system further includes a second heat sink coupled with the second heat-generating device and having a plurality of free ends extending away from the second plane of the second heat generating device toward the free ends of the first heat sink, the second heat sink being symmetric with and facing the first heat sink.

15. The induction cooking hob of claim 13, further including a first support coupled with the first induction coil and defining at least one opening therethrough, wherein:

the cooling air path passing through the at least one opening.

16. The induction cooking hob of claim 15, wherein the at least one opening is located in a central position of the cooking hob.

17. The induction cooking hob of claim 13, further including an aluminum tray supporting the induction coil, wherein:

the cooling air path impinges the aluminum tray in the first direction.

18. The induction cooking hob of claim 13, wherein a height of the heat sink along the first direction is less than a depth and a width of the heat sink that are respectively defined normal to the plane.

19. An induction cooking hob, comprising:

a first heat-generating device defining a first plane;

a first induction coil positioned adjacent the first heat-generating device; and a cooling system, including:

a first heat sink coupled with the first heat-generating device and having a plurality of free ends extending away from the first plane of the first heat generating device along a plane; and a blower module defining a cooling air path extending in a first direction substantially perpendicular to the plurality of free ends of the first heat sink, wherein the first heat sink and the first induction coil are positioned along respective portions of the cooling air path with the first heat sink closest to the blower module, and the blower module is a radial fan located on a first lateral side of the first heat sink at a predetermined lower offset with respect to a lower base of the first heat sink with a first portion of the airflow path impinging on the first lateral side of the first heat sink; and an air deflector, wherein the air deflector deflects a second portion of the airflow path along a second direction substantially perpendicular to the lower base of the first heat sink.

* * * * *